US012595920B2

(12) United States Patent
Niskanen et al.

(10) Patent No.: US 12,595,920 B2
(45) Date of Patent: Apr. 7, 2026

(54) VENTILATION OF AN OFFICE POD

(71) Applicant: FRAMERY OY, Tampere (FI)

(72) Inventors: Teemu Niskanen, Lempäälä (FI); Jan-Kristian Ollinen, Tampere (FI)

(73) Assignee: FRAMERY OY, Tampere (FI)

( * ) Notice: Subject to any disclaimer, the term of this patent is extended or adjusted under 35 U.S.C. 154(b) by 0 days.

(21) Appl. No.: 18/847,768

(22) PCT Filed: Apr. 18, 2023

(86) PCT No.: PCT/FI2023/050216
§ 371 (c)(1),
(2) Date: Sep. 17, 2024

(87) PCT Pub. No.: WO2023/209277
PCT Pub. Date: Nov. 2, 2023

(65) Prior Publication Data

US 2025/0198636 A1 Jun. 19, 2025

(30) Foreign Application Priority Data

Apr. 25, 2022 (FI) ..... 20225342

(51) Int. Cl.
*F24F 7/02* (2006.01)
*E04H 1/12* (2006.01)
*F24F 11/00* (2018.01)

(52) U.S. Cl.
CPC ..... *F24F 7/025* (2013.01); *E04H 1/125* (2013.01); *F24F 11/0001* (2013.01); *F24F 2011/0002* (2013.01)

(58) Field of Classification Search
CPC .. F24F 7/025; F24F 7/0001; F24F 2011/0002; E04H 1/125
(Continued)

(56) References Cited

U.S. PATENT DOCUMENTS 4,901,764 A * 2/1990 Meline ..... F24F 9/00 454/189
6,375,562 B1 * 4/2002 Hein ..... E06B 3/903 49/31
(Continued)

FOREIGN PATENT DOCUMENTS

CN 213087534 U 4/2021
EP 3485201 A1 5/2019
(Continued)

OTHER PUBLICATIONS

European Patent Office, International Search Report, Application No. PCT/FI2023/050216, mailed Jul. 4, 2023, 4 pages.
(Continued)

*Primary Examiner* — Avinash A Savani
*Assistant Examiner* — Dana K Tighe
(74) *Attorney, Agent, or Firm* — Ziegler IP Law Group, LLC.

(57) ABSTRACT

An office pod enclosing a workspace inside of the pod, including a first ventilation unit configured to produce a first predominant air flow entering the workspace via a first air channel, and a second ventilation unit configured to produce a second predominant air flow entering the workspace via a second air channel, separate from the first air channel, wherein the office pod is configured to use the first predominant air flow to direct the second predominant air flow.

11 Claims, 4 Drawing Sheets

(58) Field of Classification Search
USPC ..... 454/256, 49, 188
See application file for complete search history.

(56) References Cited

U.S. PATENT DOCUMENTS

| | | | | |
|---|---|---|---|---|
| 2019/0186765 | A1 | 6/2019 | Haveri et al. | |
| 2021/0115687 | A1 | 4/2021 | Phillips | |
| 2022/0268068 | A1* | 8/2022 | Kitagawa | E05C 19/166 |
| 2022/0268466 | A1* | 8/2022 | Doerr | B01D 46/62 |

FOREIGN PATENT DOCUMENTS

| | | | |
|---|---|---|---|
| EP | 3926245 | A1 | 12/2021 |
| JP | 2010164271 | A | 7/2010 |
| JP | 2011231989 | A | 11/2011 |
| WO | 2018011462 | A1 | 1/2018 |
| WO | 2019234303 | A1 | 12/2019 |

OTHER PUBLICATIONS

European Patent Office, Written Opinion of the International Searching Authority, Application No. PCT/FI2023/050216, mailed Jul. 4, 2023, 8 pages.
Finnish Patent and Registration Office, Office Action, Application No. 20225342, mailed Aug. 30, 2022, 7 pages.

* cited by examiner

VENTILATION OF AN OFFICE POD

FIELD

The present disclosure generally relates to ventilation of office pods or similar.

BACKGROUND

This section illustrates useful background information without admission of any technique described herein representative of the state of the art.

Office pods, such as soundproof conference or phone booths, are increasingly used in modern furnishing of workplaces as well as public spaces. Such pods are often used for working, telephone calls and video conferencing.

The office pods require an air circulation, or ventilation, in order to ascertain adequate exchange of air and to prevent the temperature within the pod from rising unpleasantly high.

SUMMARY

It is an object of certain embodiments of the present disclosure to provide a novel and inventive way of providing ventilation of an office pod.

According to a first example aspect of the invention there is provided an office pod enclosing a workspace inside of the pod, comprising:

- a first ventilation unit configured to produce a first predominant air flow entering the workspace via a first air channel; and
- a second ventilation unit configured to produce a second predominant air flow entering the workspace via a second air channel, separate from the first air channel, wherein the office pod is configured to use the first predominant air flow to direct (or guide) the second predominant air flow.

In certain embodiments, the second ventilation unit is separate from the first ventilation unit.

In certain embodiments, the office pod comprises the first ventilation unit configured to produce the first predominant air flow entering the workspace via the first air channel and a first vent.

In certain embodiments, the office pod comprises the second ventilation unit configured to produce the second predominant air flow entering the workspace via the second air channel and a second vent.

In certain embodiments, the second flow channel being separate from the first channel means that the flow channels are in no flow communication within the pod structure.

In certain embodiments, the second flow channel and the second vent are separate from the first flow channel and the first vent.

In certain embodiments, the office pod comprises a control apparatus configured to adjust flow ratio between the individual air flows (i.e., the first and second predominant air flows).

In certain embodiments, the office pod comprises a control apparatus to adjust the amount of air carried by each of the said air flows with respect to the amount of air carried by the other air flow (or to adjust the amount of air carried by one air flow with respect to the amount of air carried by the other air flow) so that the first predominant air flow is used to direct the second predominant air flow within the workspace.

In certain embodiments, a predominant air flow significantly participates in the air exchange of the pod (in contrast to just being a marginal flow in terms of the amount of air carried by it). Accordingly, the predominant flow e.g. is no bleed flow or side flow of similar.

In certain embodiments, the first air channel comprises a first vent at an interface of the workspace and pod structure directing the first predominant air flow into the workspace and the second air channel comprises a second vent at in interface of the workspace and pod structure directing the second predominant air flow into the workspace.

In certain embodiments, the office pod comprises a first vent directing the first predominant air flow into the workspace and a second vent directing the second predominant air flow into the workspace. In certain embodiments, the vents reside at opposite sides of the pod or at opposite inner top corners of the pod.

In certain embodiments, the ventilation units are implemented in a roof structure of the pod.

In certain embodiments, both of the first and second air flows direct (or guide) the other flow.

In certain embodiments, at least the first predominant flow within the workspace is a directed air flow.

In certain embodiments, the first predominant air flow is used to direct (or guide) the second predominant air flow by the first flow colliding with the second flow within the workspace.

In certain embodiments, the direction of the first predominant air flow within the workspace is substantially horizontal, and the second predominant air flow is an inclined flow (its flow direction being at an angle to both the horizontal direction and to the vertical direction). In certain embodiments, the direction of the second predominant air flow within the workspace is inclined with respect to the direction of the first predominant air flow within the workspace.

In certain embodiments, the first and second vents are immovable (or stationary). Accordingly, in certain embodiments, the first and second vents are implemented without the vents having moving parts.

In certain embodiments, the first predominant air flow travels at least about a half of a total horizontal inner distance between pod walls before it collides with the second predominant air flow. In certain embodiments, the first predominant air flow travels more than a half of a total horizontal inner distance between pod walls before it collides with the second predominant air flow.

In certain embodiments, the first and second air channels are without moving parts downstream of the respective ventilation units.

In certain embodiments, the flow direction of the first air channel is opposite to the flow direction of the second air channel within the pod structure.

In certain embodiments, sound absorbing material limits the first and second air channel at the sides. In certain embodiments, sound absorbing material limits the first and second air channel at the top. In certain embodiments, sound absorbing material limits the first and second air channel at the bottom. In certain embodiments, respective first and second air channels are provided with hard top and bottom surfaces (such as metal surfaces) and sound absorbing material layers as side surfaces.

In certain embodiments, the pod is configured to implement a pod flow mode. In the pod flow mode, the first predominant air flow being substantially horizontal collides with the second predominant air flow being an inclined air flow in the route of the second predominant air flow such that the first predominant air flow directs the second predominant air flow further down (substantially along a wall surface, or bypassing a central area of the pod).

In certain embodiments, the pod is configured to implement a direct flow mode. In the direct flow mode, the first predominant air flow being substantially horizontal collides with the second predominant air flow being an inclined air flow in the route of the second predominant air flow such that the flow rate of the first predominant air flow is reduced so that the direction of the second predominant air flow after the collision is rather directly towards a user (or central area of the pod).

In certain embodiments, the pod is configured to implement a sweep mode. In the sweep mode, the flow rate of the first predominant air flow is periodically changed from a reduced value to an increased value and back so that the second predominant air flow is directed to periodically sweep between the flow directions of the pod flow mode and the direct flow mode.

In certain embodiments, the pod is configured to implement a pod flow mode, a direct flow mode, and a sweep mode, wherein in each flow mode, the first predominant air flow being substantially horizontal collides with the second predominant air flow being an inclined air flow in the route of the second predominant air flow such that:

in the pod flow mode, the first predominant air flow directs the second predominant air flow further down (substantially along a wall surface, or bypassing a central area of the pod);

in the direct flow mode, the flow rate of the first predominant air flow is reduced so that the direction of the second predominant air flow after the collision is rather directly towards a user (or central area of the pod); and in the sweep mode, the flow rate of the first predominant air flow is periodically changed from a reduced value to an increased value and back so that the second predominant air flow is directed to periodically sweep between the flow directions of the pod flow mode and the direct flow mode.

In certain embodiments, the pod is optionally configured to implement a waterfall mode. In the waterfall mode, both the first and the second predominant air flows flow substantially horizontally until they collide at the center and continue downwards.

In certain embodiments, both the first predominant air flow and the second predominant air flow carry substantially an equal amount of air to the workspace, or both flows carry about 50% of a provided total air flow.

In certain embodiments, the pod comprises an air infeed at a top section of the pod, and an air outlet at a bottom section of the pod.

In certain embodiments, the pod provides for an adjustable non-uniform air flow within the workspace.

In certain embodiments, the office pod is configured to perform a stabilization sequence during operation comprising:

increasing a flow rate of the first predominant air flow for a predetermined period of time.

According to a second example aspect of the invention there is provided a control apparatus for an office pod of the first aspect or any of its embodiments enclosing a workspace inside of the pod, comprising:

at least one processor; and at least one memory including computer program code, the at least one memory and the computer program code being configured, with the at least one processor, to cause the office pod to perform:

producing by a first ventilation unit a first predominant air flow entering the workspace via a first air channel;

producing by a second ventilation unit a second predominant air flow entering the workspace via a second air channel, separate from the first air channel; and using the first predominant air flow to direct the second predominant air flow.

In certain embodiments, the first predominant air flow enters the workspace via the first air channel and a first vent.

In certain embodiments, the second predominant air flow enters the workspace via the second air channel and a second vent.

In certain embodiments, the second flow channel and the second vent are separate from the first flow channel and the first vent.

In certain embodiments, the control apparatus is configured to adjust flow ratio between the individual air flows (i.e., the first and second predominant air flows).

In certain embodiments, the control apparatus is configured to adjust the amount of air carried by each of the said air flows with respect to the amount of air carried by the other air flow so that the first predominant air flow is used to direct the second predominant air flow within the workspace.

In certain embodiments, the control apparatus comprises the at least one memory and the computer program code being configured, with the at least one processor, to cause the office pod to perform:

using the first predominant air flow to direct the second predominant air flow within the workspace by adjusting the amount of air carried by each of the said air flows with respect to the amount of air carried by the other air flow (or by adjusting the amount of air carried by one air flow with respect to the amount of air carried by the other air flow).

According to a third example aspect of the invention there is provided a computer program product comprising a non-transitory computer readable memory medium having the computer program code of the third example aspect stored thereon.

Any foregoing memory medium may comprise a digital data storage such as a data disc or diskette, optical storage, magnetic storage, holographic storage, opto-magnetic storage, phase-change memory, resistive random access memory, magnetic random access memory, solid-electrolyte memory, ferroelectric random access memory, organic memory or polymer memory. The memory medium may be formed into a device without other substantial functions than storing memory or it may be formed as part of a device with other functions, including but not limited to a memory of a computer, a chip set, and a sub assembly of an electronic device.

Different non-binding example aspects and embodiments have been illustrated in the foregoing. The embodiments in the foregoing are used merely to explain selected aspects or steps that may be utilized in different implementations. Some embodiments and features may be presented only with reference to certain example aspects. It should be appreciated that corresponding embodiments and features apply to other example aspects as well. In particular, the embodiments and features described in the context of the first aspect are applicable to each further aspect, and vice versa. Any appropriate combinations of the embodiments may be formed. Any apparatus and/or methods in the description and/or figures not covered by the claims are examples useful for understanding the invention.

BRIEF DESCRIPTION OF THE FIGURES

Some example embodiments will be described with reference to the accompanying figures, in which.

DETAILED DESCRIPTION

Figure 1:
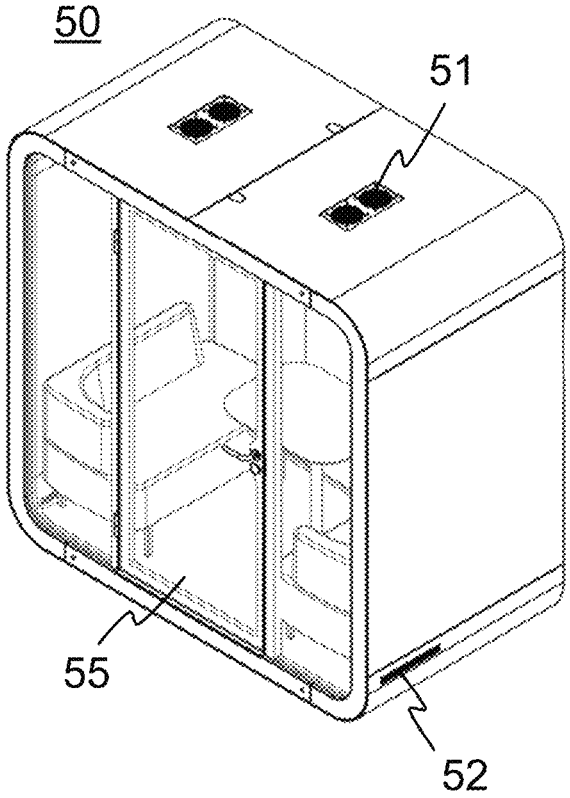
Fig. 1 Prior art
FIG. 1 shows a conventional office pod.
Figure 2:
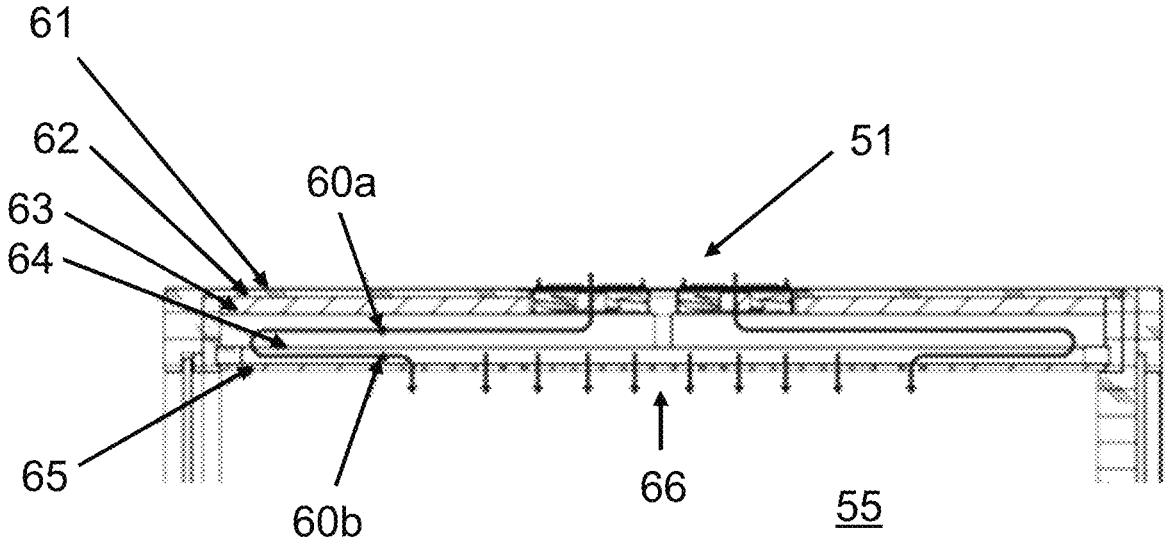
Fig. 2 Prior art
FIG. 2 shows a conventional pod structure of the pod of the type shown in FIG. 1 with air channels for ventilation.

In the following description, like reference signs denote like elements or steps. Reference is made to the FIGS. 1-7 with the following numerals and denotations:

50 Office pod
51 Fan
52 Outlet
55 Workspace
60*a* First channel section
60*b* Second channel section
61 First layer
62 Second layer
63 Third layer
64 Fourth layer
65 Fifth layer
66 Ventilation aperture
70 Apparatus
71 Processor
72 Memory
73 Work memory
74 User interface
75 Communication interface
76 Non-volatile memory
77 Program code
78 Data
150 Office pod
151*a* First HVAC unit
151*b* Second HVAC unit
152*a* First air channel
152*b* Second air channel
153*a* First air channel top surface
153*b* Second air channel top surface
154*a* First air channel bottom surface
154*b* Second air channel bottom surface
155 Workspace
156*a* First vent
156*b* Second vent
157 Sound dampening material
175 Pod structure FIGS. 1 and 2 show ventilation of a conventional office pod 50. Air is fed into a workspace 55 provided by the pod 50 through fan units 51 in the roof, and an air outlet 52 is arranged in a lower corner of the pod 50. In more detail, as depicted by a sectional view of FIG. 2, the conventional office pod 50 provides for a sandwich-type structure comprising a first layer 61 that is of sound stopping material, a second layer 62 and a third layer 63 that are of sound dampening material, a fourth layer 64 that is of sound stopping material, and a fifth layer 65 that is of sound dampening or acoustic material.

Air channels comprising curves or bends travel from fan units 51 to a ventilation aperture 66. In particular, as shown at the left side of the structure, a first channel portion 60*a* of a first air channel horizontally extends from a respective fan unit 51 towards an edge of the structure where its end is joined with an end of a second channel portion 60*b*. The second channel portion 60*b* extends horizontally therefrom to the ventilation aperture 66. A similar air channel is placed at the right side of the structure extending from another fan unit 51 to the ventilation aperture 66.

The ventilation aperture 66 placed at the centre of the structure contains holes through which air flows downwards into the workspace 55.

Figure 3:
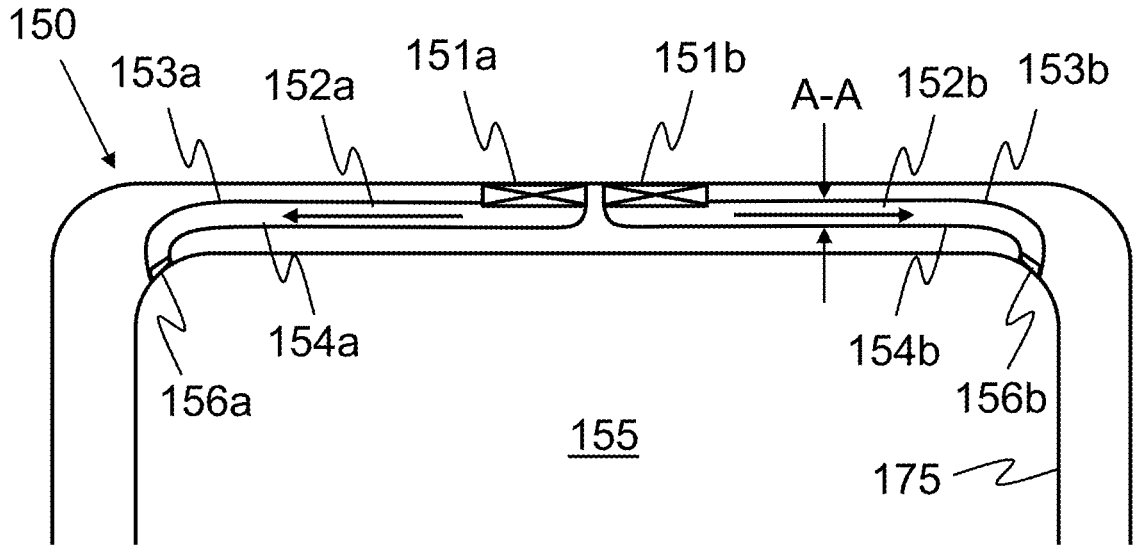
FIG. 3 shows a pod structure in accordance with certain embodiments of the present disclosure.

FIG. 3 shows a structure 175 of an office pod 150 in accordance with certain embodiments of the present disclosure. The pod structure 175 comprises a first HVAC unit (or ventilation unit) 151*a* comprising a first fan, and a second HVAC unit (or ventilation unit) 151*b* comprising a second fan. The first HVAC unit 151*a* feeds fresh air to a first air channel 152*a* that extends within the structure to a first vent 156*a*. The first vent 156*a* is shaped so as to provide a first directional air flow into the workspace 155. The second HVAC unit 151*b* feeds fresh air to a second air channel 152*b* that extends within the structure to a second vent 156*b*. The second vent 156*b* is shaped so as to provide a second directional air flow into the workspace 155. The second air channel 152*b* is separate from the first air channel 152*a*. And, the second vent 156*b* is placed at a distance apart from the first vent 156*a*. In certain embodiments, the first and second vents 156*a*, 156*b* are placed at respective opposite inner top corners of the pod 150.

The first air channel 152*a* is limited at the top by a top surface 153*a*, and at the bottom by a bottom surface 154*a*. Similarly, the second air channel 152*a* is limited at the top by a top surface 153*b*, and at the bottom by a bottom surface 154*b*. The flow direction of air within the air channels 152*a*, 152*b* is marked by arrows in FIG. 3.

Figure 4:
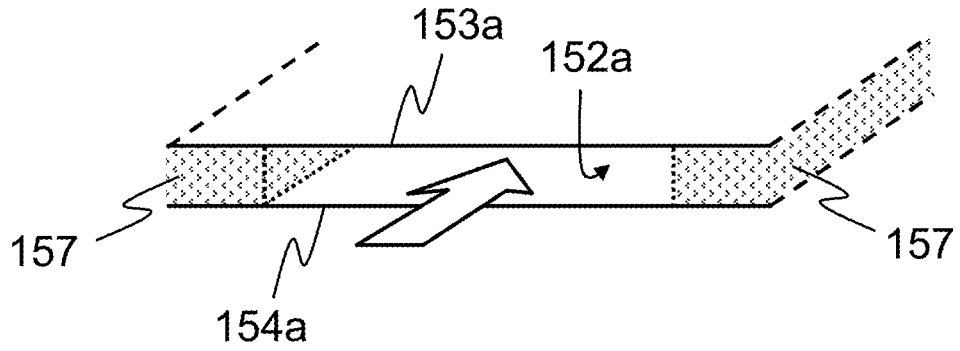
FIG. 4 shows a schematic cross-sectional view at section A-A marked in the preceding FIG. 3.

FIG. 4 shows a schematic cross-sectional view at section A-A marked in FIG. 3 in accordance with certain embodiments. Practically, the section A-A shows certain details the first air channel 152*a*. In certain embodiments, the first air channel 152*a* has a rectangular cross-section. The first air channel 152*a* is limited at the top by the top surface 153*a*, and at the bottom by the bottom surface 154*a*. The material of the top and bottom surfaces 153*a*, 154*a* may be hard, for example metal in certain embodiments. In certain embodiments, the top and bottom surfaces 153*a*, 154*a* are implemented by suitable plates, for example, sheet metal plates. In other embodiments, the top and/or bottom surfaces 153*a*, 154*a* are of sound absorbing material, for example of porous or open-cell material (one or more material layers may be included). In certain embodiments, as shown in FIG. 4, to improve sound absorption properties of the structure 175, the first air channel 152*a* is limited at sides by sound absorbing material 157, for example porous or open-cell material. Although not separately mentioned, the preceding also applies to the second air channel 152*b*.

It has been described that the first air channel 152*a* provides the workspace 155 with a first air flow via the first vent 156*a*, and the second air channel 153*b* provides the workspace 155 with a second air flow via the second vent 156*b*. Both of the first and second air flows are predominant (or major) air flows significantly participating in the air exchange of the pod 150 (in contrast to either of the flows just being a marginal flow in terms of the amount of air carried by it). However, the amount of air carried by each of the flows is adjustable with respect to the amount of air carried by the other flow.

In order to meet ventilation preferences of each user, the FIGS. 5*a*-5*d* show certain modes of operation in accordance with certain embodiments. Different modes of operation can be provided by adjusting the amount of air provided by each of the flows so that the first air flow adjusts the direction of the second air flow within the workspace 155.

The first air flow enters the workspace 155 from the first vent 156*a* and the second air flow from the second vent 156*b*.

Figure 5A:
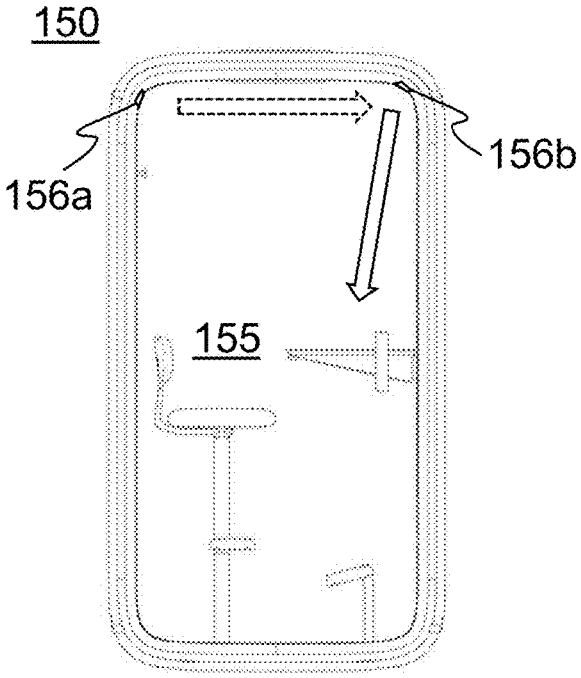
FIGS. 5*a*-5*c* show different modes of operation in accordance with certain embodiments.

FIG. 5*a* shows a pod flow mode. In this mode, the direction of the first air flow entering the workspace 155 from the first vent 156*a* is substantially horizontal, and the direction of the second air flow entering the workspace 155 from the second vent 156*b* is at an inclined angle with respect to both the horizontal and the vertical direction. The first air flow collides with the second air flow in the route of the second air flow directing (or turning) the second air flow further down (closer to the rightmost wall of the pod in FIG. 5*a*). In this mode, the user sitting on a pod chair does not feel the movement of the air that much.

Figure 5B:
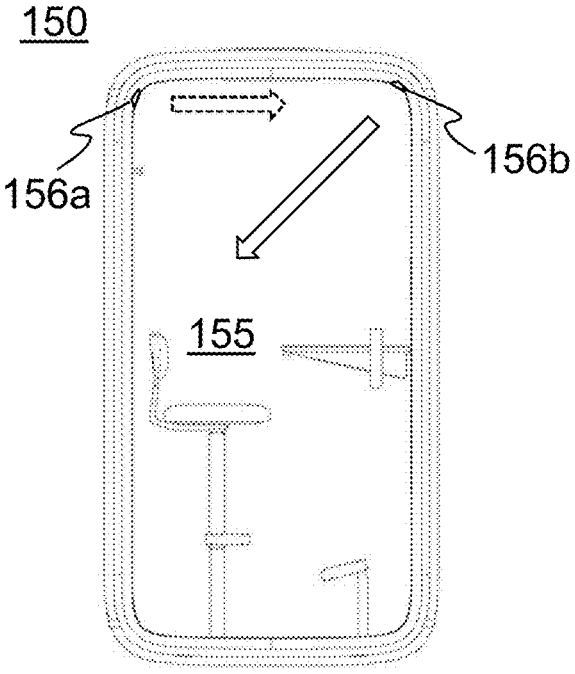

FIG. 5*b* shows a direct flow mode. In this mode, again, the direction of the first air flow entering the workspace 155 from the first vent 156*a* is substantially horizontal, and the direction of the second air flow entering the workspace 155 from the second vent 156*b* is at an inclined angle with respect to both the horizontal and the vertical direction. However, the flow rate of the first flow is reduced so that the first flow, when colliding with the second flow, does not direct (or turn) the second flow so much downward as in the mode shown in FIG. 5*a*. Accordingly, the flow direction of the second flow (or a combined flow) after the collision is rather directly towards the user.

Figure 5C:
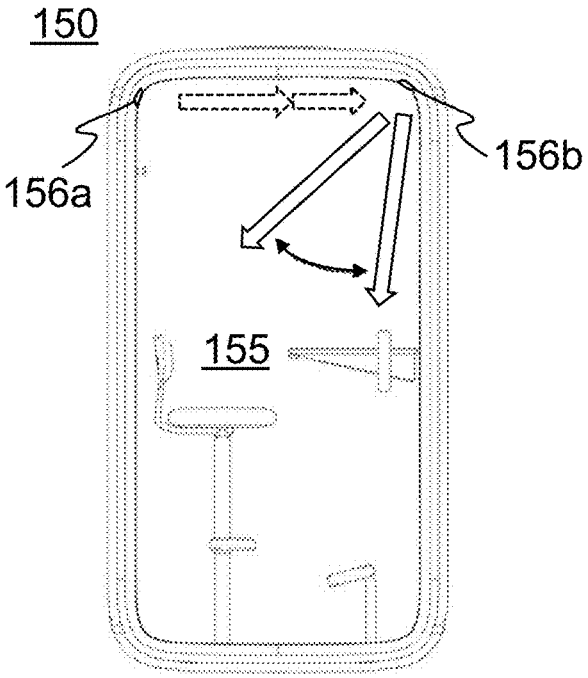

FIG. 5*c* shows a sweep mode. In this mode, again, the direction of the first air flow entering the workspace 155 from the first vent 156*a* is substantially horizontal, and the direction of the second air flow entering the workspace 155 from the second vent 156*b* is at an inclined angle with respect to both the horizontal and the vertical direction. The flow rate of the first air flow is periodically changed from a reduced value to an increased value and back. As a result, the second flow (or the combined flow) periodically sweeps between the flow directions of FIGS. 5*a* and 5*b* as indicated by the curved arrow in FIG. 5*c*.

Figure 5D:
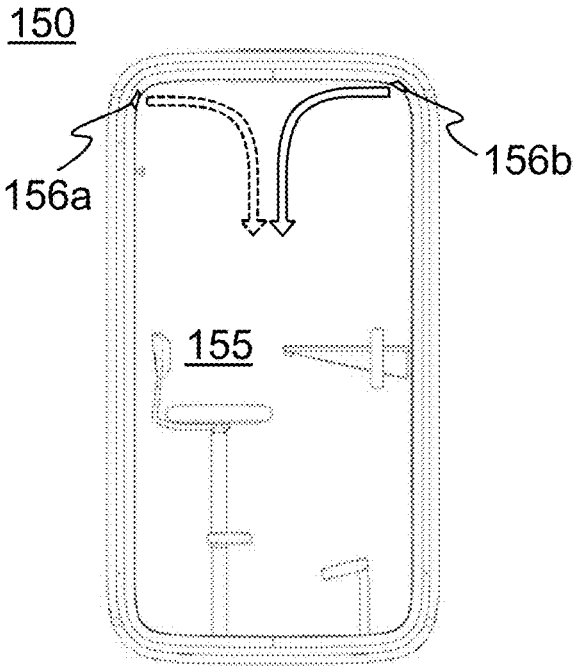

FIG. 5*d* shows a waterfall mode. In this mode both the first and the second air flows flow substantially horizontally until they collide at the center and continue downwards.

As shown in FIGS. 5*a*-5*d*, the flow direction of air within the pod 150, as experienced by a pod user, can be adjusted by adjusting the flow ratio of the individual air flows without the vents 156*a*, 156*b* having moving parts.

Figure 6:
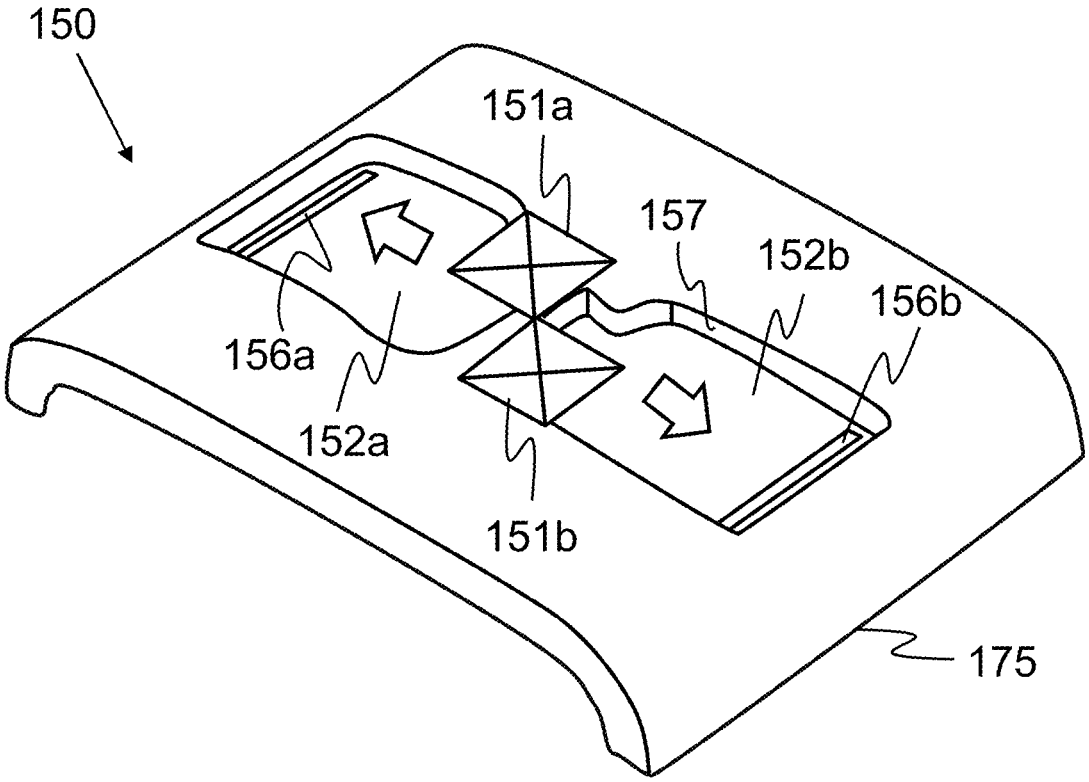
FIG. 6 shows a schematic perspective view of the pod structure in accordance with certain embodiments.

FIG. 6 shows a schematic perspective view of the structure 175 of the pod 150 in accordance with certain embodiments. The first and second HVAC units 151*a*, 151*b* are diagonally placed and embedded within a curved roof structure providing air flows to respective channels 152*a*, 152*b* towards respective vents 156*a*, 156*b*.

Figure 7:
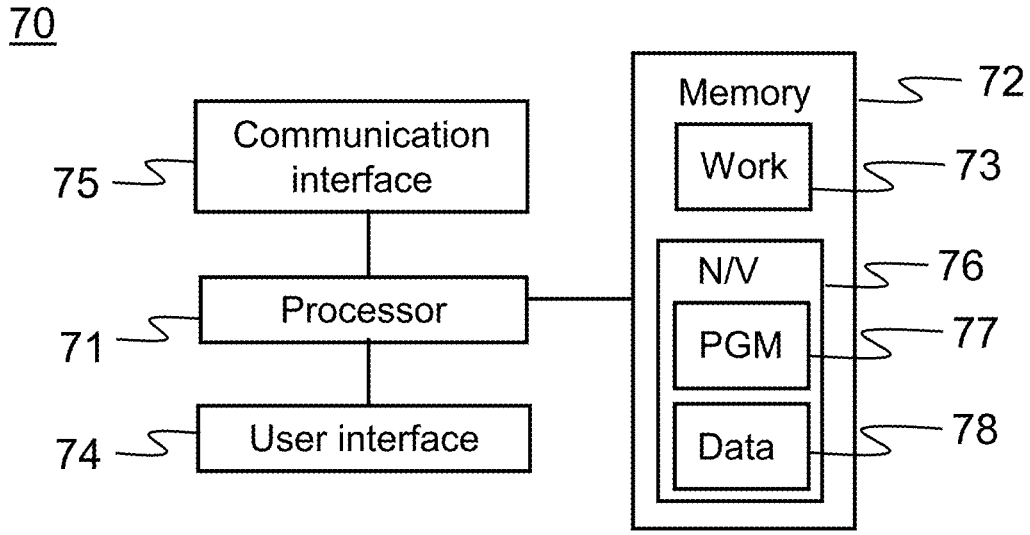
FIG. 7 shows an apparatus in accordance with certain embodiments.

FIG. 7 an apparatus in accordance with certain embodiments. In certain embodiments, the shown apparatus 70 is, inter alia, capable of functioning as a control apparatus for adjusting the ventilation operation of the pod 150. The apparatus 70 is for example a general-purpose computer or some other electronic data processing apparatus.

The apparatus 70 comprises a communication interface 75, at least one processor 71, a user interface 74, and at least one memory 72.

The communication interface 75 comprises in an embodiment a wired and/or wireless communication circuitry, such as Ethernet, Wireless LAN or WI-FI, Bluetooth, GSM, CDMA, WCDMA, LTE, and/or 5G circuitry. The communication interface 75 can be integrated in the apparatus 70 or provided as a part of an adapter, card or the like, that is attachable to the apparatus 70. The communication interface 75 may support one or more different communication technologies. The apparatus 70 may also or alternatively comprise more than one communication interface 75.

The at least one processor 71 may be a central processing unit (CPU), a microprocessor, a digital signal processor (DSP), a graphics processing unit, an application specific integrated circuit (ASIC), a field programmable gate array, a microcontroller, or the like, or a combination of such elements.

The user interface 74 may comprise a circuitry for receiving input from a user of the apparatus 70, e.g., via a keyboard, graphical user interface shown on the display of the apparatus 70, speech recognition circuitry, microphone, or an accessory device, such as a headset, and for providing output to the user via, e.g., a graphical user interface or a loudspeaker.

In certain embodiments, the user interface 74 and the communication interface 75 provide the user of the pod 150 with an additional display, a speaker system, and/or handsfree functions or the like.

The at least one memory 72 comprises a work memory 73 and a persistent (non-volatile, N/V) memory 76 configured to store computer program code 77 and data 78. The memory 76 may comprise any one or more of: a read-only memory (ROM), a programmable read-only memory (PROM), an erasable programmable read-only memory (EPROM), a random-access memory (RAM), a flash memory, a data disk, an optical storage, a magnetic storage, a smart card, a solid state drive (SSD), or the like.

The apparatus 70 may comprise a plurality of memories 76. The memory 76 may be constructed as a part of the apparatus 70 or as an attachment to be inserted into a slot, port, or the like of the apparatus 70 by a user or by another person or by a robot. The memory 76 may serve the sole purpose of storing data, or be constructed as a part of an apparatus 70 serving other purposes, such as processing data.

A skilled person appreciates that, depending on the embodiment, in addition to the elements shown in FIG. 7, the apparatus 70 may comprise other elements, such as further microphones, displays, as well as additional circuitry such as an input/output (I/O) circuitry, memory chips, application-specific integrated circuits (ASIC), a processing circuitry for specific purposes such as a source coding/decoding circuitry, a channel coding/decoding circuitry, a ciphering/deciphering circuitry, and the like. Additionally, the apparatus 70 may comprise a disposable or rechargeable battery (not shown) for powering the apparatus 70 when an external power supply is not available.

As to the ventilation operation of the pod 150, the at least one processor 71 controls the operation of the HVAC units 151*a*, 151*b* based on the program code 77. Control signals to control e.g. fan speeds of the fans comprised by the HVAC units 151*a*, 151*b*, and start and stop commands, can be sent via the communication interface 75 to implement the preceding modes of operation (as e.g. shown in FIGS. 5*a*-5*d*).

Further, in certain embodiments, the user interface 74 comprises one or more mechanical devices, for example, switches enabling the user to adjust the ventilation. In yet further embodiments, the communication interface 75 provides the user with a possibility to adjust the ventilation by their mobile phone or another mobile terminal. In yet further embodiments, the pod 150 comprises a controller or controllers (not shown) enabling a direct (manual) control of power levels of the first and second fans.

Various embodiments have been presented. It should be appreciated that in this document, words "comprise", "include", and "contain" are each used as open-ended expressions with no intended exclusivity.

In certain embodiments, both the mentioned first and second air flows provide about 50% of the total air flow.

In normal operation, the circulation of air within the pod does not become disturbed and/or the first (guiding) air flow and the second (main) air flow do not switch sides so that the first air flow becomes the main air flow and the second air flow becomes the guiding air flow (then e.g. directing an air flow towards a neck of the user).

However, for more certainly, the following flow stabilizing sequence is performed during operation in certain embodiments:

1) increase flow rate of first air flow for a predefined stabilization period (e.g. 5 or 10 seconds);
2) resume normal operation.

In certain embodiments, this stabilizing sequence is performed in response to detecting a door activity of the pod (e.g. the door being just opened or closed).

In certain further embodiments, a start-up sequence of the fans is as follows:

1) start the fan of the first HVAC unit 151*a* first (optionally with an increased flow rate)
2) then (e.g., a few seconds later) start the fan of the second HVAC unit 151*b*
3) then adjust (or reduce) the flow rate of the first HVAC unit 151*a* to a value as determined by desired mode of operation.

Without limiting the scope and interpretation of the patent claims, certain technical effects of one or more of the example embodiments disclosed herein are listed in the following. A technical effect is the ability to adjust air flow directions within an office pod. And, this can be achieved without any moving parts (beside fans). Accordingly, the direction control mechanism is very efficient and robust.

The foregoing description has provided by way of non-limiting examples of particular implementations and embodiments a full and informative description of the best mode presently contemplated by the inventors for carrying out the invention. It is however clear to a person skilled in the art that the invention is not restricted to details of the embodiments presented in the foregoing, but that it can be implemented in other embodiments using equivalent means or in different combinations of embodiments without deviating from the characteristics of the invention.

Furthermore, some of the features of the afore-disclosed example embodiments may be used to advantage without the corresponding use of other features. As such, the foregoing description shall be considered as merely illustrative of the principles of the present invention, and not in limitation thereof. Hence, the scope of the invention is only restricted by the appended patent claims.

The invention claimed is:

1. An office pod enclosing a workspace inside of the pod, comprising:

a first ventilation unit configured to produce a first predominant air flow entering the workspace via a first air channel and a first air vent; and a second ventilation unit configured to produce a second predominant air flow entering the workspace via a second air channel and a second vent, the second air channel and the second vent being separate from the first air channel and the first vent; and a control apparatus configured to adjust a flow rate of the first predominant air flow with respect to a flow rate of the second predominant air flow such that proximate the first vent and the second vent within the workspace, the first predominant air flow collides with the second predominant airflow and turns a direction of the second predominant air flow within the workspace.

2. The office pod of claim 1, wherein the first predominant air flow directs the second predominant air flow by the first flow colliding with the second flow within the workspace proximate the first vent and the second vent.

3. The office pod of claim 1, wherein a direction of the first predominant air flow within the workspace is substantially horizontal relative to a top wall of the office pod, and a direction of the second predominant air flow is inclined relative to the direction of the first predominant air flow.

4. The office pod of claim 1, wherein the first vent is disposed at a first top corner of the office pod and the second vent is disposed at a second top corner of the opposite pod, opposite the first top corner.

5. The office pod of claim 1, wherein the first vent and the second vents are implemented without having moving parts.

6. The office pod of claim 1, wherein the first predominant air flow travels at least about a half of a total horizontal inner distance between a first side wall of the office pod and a second side wall of the office pod opposite the first side wall before the first predominant air flow collides with the second predominant air flow.

7. The office pod of claim 1, wherein the pod is configured to implement a pod flow mode, a direct flow mode, and a sweep mode.

8. The office pod of claim 7, wherein the pod is configured to implement a waterfall mode.

9. The office pod of claim 1, wherein the control apparatus is configured to cause the office pod to perform a stabilization sequence during operation comprising:

increasing the flow rate of the first predominant air flow for a predetermined period of time.

10. The office pod of claim 1 wherein the control apparatus comprises:

at least one processor; and at least one memory including computer program code, the at least one memory and the computer program code being configured, with the at least one processor, to cause the office pod to:

produce by the first ventilation unit the first predominant air flow entering the workspace via the first air channel and the first vent; and produce by the second ventilation unit the second predominant air flow entering the workspace via the second air channel and the second vent.

11. The office pod according to claim 1 wherein the first ventilation unit comprises a first HVAC unit and the second ventilation unit comprises a second HVAC unit.

* * * * *